US008290407B2

(12) United States Patent
Maeshima

(10) Patent No.: US 8,290,407 B2
(45) Date of Patent: Oct. 16, 2012

(54) TONER SUPPLY APPARATUS WITH A DRIVE MEMBER FOR DRIVING AN AGITATOR AND WITH A FILM COVERING THE PERIPHERY OF THE DRIVE MEMBER

(75) Inventor: Masanobu Maeshima, Osaka (JP)

(73) Assignee: Kyocera Mita Corporation (JP)

( * ) Notice: Subject to any disclaimer, the term of this patent is extended or adjusted under 35 U.S.C. 154(b) by 421 days.

(21) Appl. No.: 12/694,512

(22) Filed: Jan. 27, 2010

(65) Prior Publication Data

US 2010/0196059 A1 Aug. 5, 2010

(30) Foreign Application Priority Data

Jan. 30, 2009 (JP) ..... 2009-020884
Jan. 30, 2009 (JP) ..... 2009-020904

(51) Int. Cl.
*G03G 15/08* (2006.01)
*B01F 7/00* (2006.01)

(52) U.S. Cl. ..... 399/263; 366/319; 366/320

(58) Field of Classification Search ..... 399/256, 399/263, 262; 366/309, 311, 312, 313, 319, 366/325.7, 325.8, 326.1, 325.94, 320
See application file for complete search history.

(56) References Cited

U.S. PATENT DOCUMENTS 5,074,125 A * 12/1991 Schifferly ..... 366/312
7,349,657 B2 * 3/2008 Sato et al. ..... 399/263
7,412,192 B2 * 8/2008 Nakajima et al. ..... 399/262
8,027,619 B2 * 9/2011 Murata et al. ..... 399/263
8,055,162 B2 * 11/2011 Ohgoshi et al. ..... 399/263
2004/0223791 A1 * 11/2004 Yamada et al. ..... 399/263

FOREIGN PATENT DOCUMENTS

JP 9-265229 10/1997

* cited by examiner

*Primary Examiner* — Susan Lee
(74) *Attorney, Agent, or Firm* — Gerald E. Hespos; Michael J. Porco

(57) ABSTRACT

A toner supply apparatus is installed detachably in an image forming apparatus. The toner supply apparatus includes a container body which accommodates toner, and an agitating member which is disposed inside the container body and is driven to rotate so as to agitate toner. The agitating member includes a drive member which is driven to rotate and a film member which is fixed on the drive member, and the film member covers the periphery of the drive member in a tubular fashion.

14 Claims, 10 Drawing Sheets

TONER SUPPLY APPARATUS WITH A DRIVE MEMBER FOR DRIVING AN AGITATOR AND WITH A FILM COVERING THE PERIPHERY OF THE DRIVE MEMBER

BACKGROUND OF THE INVENTION

1. Field of the Invention

The present invention relates to a toner supply apparatus which is installed detachably in an image forming apparatus in a state of accommodating toner.

2. Description of the Related Art

Conventionally, a toner container (toner supply apparatus) is known which supplies toner to a developer apparatus provided inside an image forming apparatus, such as a printer or copying machine. This toner container is attachable and detachable with respect to the image forming apparatus, and when an amount of toner inside the toner container becomes insufficient, a user removes the toner container from the image forming apparatus and replaces it with a new toner container which contains a sufficient amount of toner.

If a toner container filled with toner is left for a long period of time before shipment, toner inside the toner container may clump together (coagulate) due to the pressure created by the toner's own weight. In particular, if the toner container is vertically oriented for a long period of time, then toner in the toner container is inclined to one side inside a long thin container. If a vibration is applied to the toner container during transport, or the like, while in this state, toner becomes very tightly clumped together. Therefore, in order to resolve the coagulated toner, an agitating member which is driven to rotate around an axis is generally provided inside a toner container. The agitating member has a shape where an agitating portion which agitates toner is provided in a projecting fashion toward the outer radial direction from the outer peripheral surface of a rotating axis. By rotating this agitating portion around the rotating axis, the coagulated toner lumps are loosened and agitated.

However, at the start of operation of the agitating member, the agitating portion rotates around the rotating axis while breaking up the coagulated toner lumps, and therefore a large load is applied to the agitating portion and the rotating axis. Consequently, there is a problem in that a large torque is required in order to start the agitating operation.

A toner container which has been improved in order to resolve this problem includes a protective mechanism composed so as to protect the agitating member by shutting off the transmission of drive force to a portion of the agitating member if excessive load is applied to the agitating member at the start of operation of the agitating member.

However, in the improved toner container, an agitating operation is only carried out by a portion of the agitating member in an initial state immediately after installing the toner container in the image forming apparatus. Therefore, sufficient toner cannot be supplied to the developer apparatus until the coagulated toner lumps inside the toner container have been completely broken up, and consequently, the image forming apparatus becomes unable to carry out suitable image forming processes, and there is a possibility of image defects.

SUMMARY OF THE INVENTION

It is an object of the present invention to provide a toner supply apparatus capable of immediately breaking up toner which is in a coagulated state inside a toner container and supplying toner to an image forming apparatus in a normal state at all times.

The toner supply apparatus relating to one aspect of the present invention which achieves this object is a toner supply apparatus installed detachably in an image forming apparatus, including: a container body which accommodates toner; and an agitating member which is disposed inside the container body and is driven to rotate so as to agitate toner, wherein the agitating member includes a drive member which is driven to rotate and a film member which is fixed on the drive member, and the film member covers the periphery of the drive member in a tubular fashion.

DETAILED DESCRIPTION OF THE PREFERRED EMBODIMENTS

Figure 1:
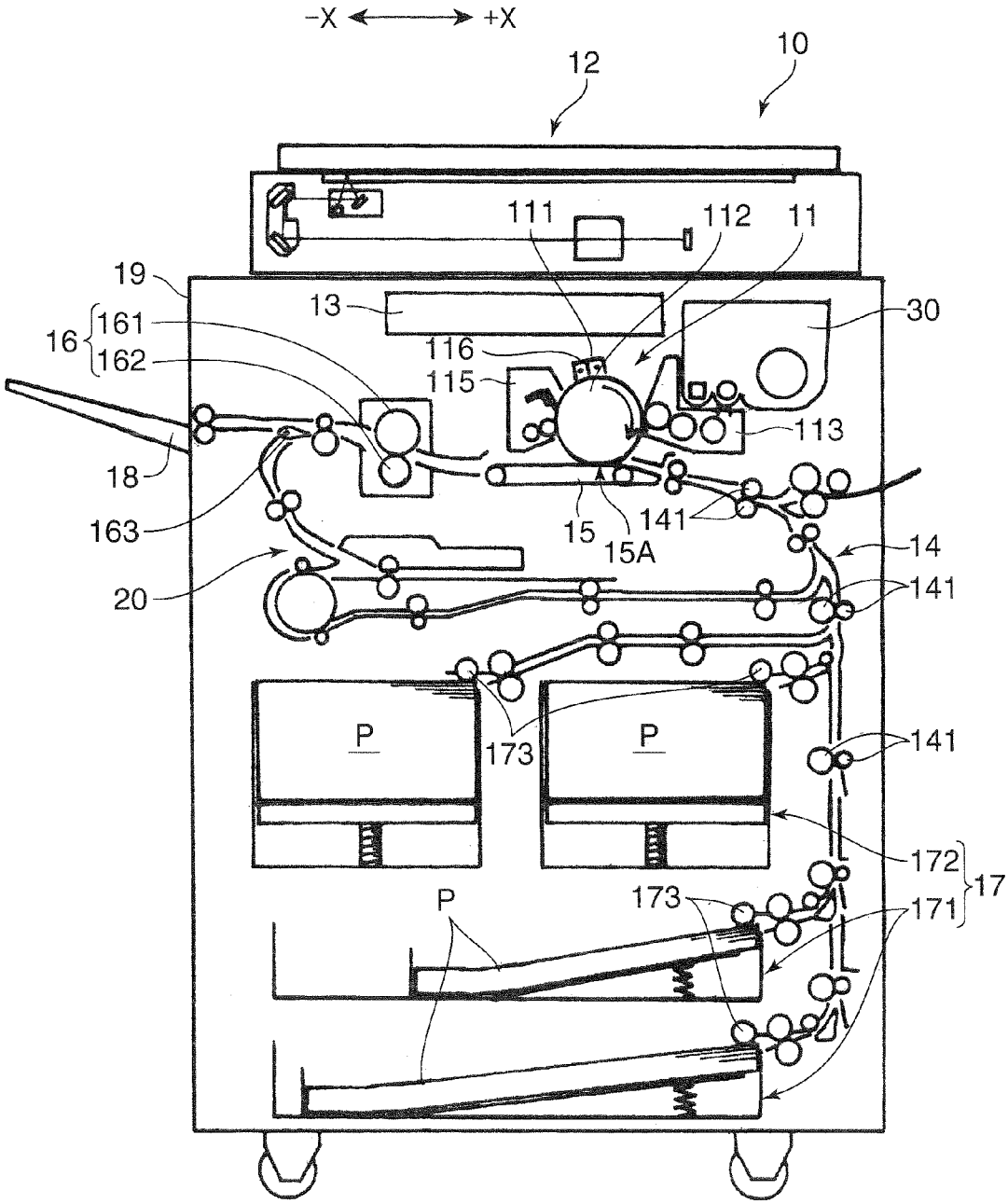
FIG. 1 is a front view cross-sectional diagram showing the overall structure of an image forming apparatus in which the toner container (toner supply apparatus) relating to an embodiment of the present invention is installed.

FIG. 1 is a front view cross-sectional diagram showing the overall structure of an image forming apparatus 10 in which a toner container relating to an embodiment of the present invention has been installed. Firstly, the overall structure of the image forming apparatus 10 will be described on the basis of FIG. 1. FIG. 1 shows a copying machine as an example of the image forming apparatus 10.

The image forming apparatus 10 includes an apparatus main body 19 and an original document reading unit 12 which reads in an original image. An image forming unit 11, an exposure apparatus 13, a paper conveyance passage 14, fixing apparatus 16 and a paper supply unit 17 are accommodated inside the apparatus main body 19. Furthermore, the image forming unit 11 includes: a charging unit 111, a photosensitive drum 112 on the peripheral surface of which an electrostatic latent image and a toner image are formed, a developer apparatus 113, a cleaning apparatus 115 and a decharging device 116.

When a copying operation is carried out, the charging unit 111 uniformly charges the peripheral surface of the photosensitive drum 112 which is rotated in the direction of the arrow in FIG. 1 (the clockwise direction). An electrostatic latent image is formed on the peripheral surface of the photosensitive drum 112 by irradiation of a laser beam from the exposure apparatus 13 based on the original image data read in by the original document reading unit 12. The developing apparatus 113 supplies developer (hereinafter called toner) for developing the electrostatic latent image, to the photosensitive drum 112, thereby forming a toner image. A supply of toner to the developing apparatus 113 is performed from the toner container (toner supply apparatus) 30 relating to the present embodiment.

The paper supply unit 17 stores a plurality of sheets of paper P. The paper P is conveyed toward the photosensitive drum 112 on which a toner image has been formed, from the paper supply unit 17 and via a paper conveyance passage 14 in which a plurality of conveyance roller pairs 141 are provided, to a transfer nip 15A formed between the photosensitive drum 112 and a transfer belt 15, which is described hereinafter. The toner image carried on the peripheral surface of the photosensitive drum 112 is transferred to the paper P by the action of the transfer belt 15 in the transfer nip 15A. The paper P onto which the toner image has been transferred is separated from the photosensitive drum 112 and conveyed to the fixing apparatus 16. The fixing apparatus 16 includes a fixing roller 161 having an in-built heat source, such as a halogen lamp, and a pressurizing roller 162 for abutting and pressing against the peripheral surface of the fixing roller 161, and a toner image fixing process is carried out by this heating and pressurizing of the paper P.

The cleaning apparatus 115 wipes away toner remaining on the peripheral surface of the photosensitive drum 112 after the transfer process, thereby cleaning the photosensitive drum. The decharging device 116 is provided on the downstream side of the cleaning apparatus 115 in the rotation direction of the photosensitive drum 112, and removes the residual charge on the peripheral surface of the photosensitive drum 112.

The paper P which has passed through the fixing apparatus 16 is conveyed to a paper conveyance path which branches in a plurality of directions, and the conveyance direction of the paper is sorted by a path switching mechanism having a paper switching guides 163 provided at the branching point of the paper conveyance path on the paper output side. In the case of a single-side copy, the paper P is output directly to the paper output tray 18. In the case of double-side copying, the paper is fed to a double-side copy conveyance unit 20 where the front/rear surfaces of the paper are inverted, the paper is returned again to the transfer nip 15A and a transfer process is performed on the rear surface side, and after a fixing process by the fixing apparatus 16, the paper is output to the output tray 18.

The paper conveyance unit 17 includes: a plurality of paper cartridges 171 which store small quantities of paper P; stockers 172 which stocks a large quantity of paper P, and pick-up rollers 173 for feeding out the uppermost paper P from the stack of paper stored in the paper cartridge 171 and stocker 172 and supplying same via the paper conveyance passage 14 to the transfer nip 15A. The paper cartridges 171 and the stockers 172 are installed detachably with respect to the apparatus main body 19, and are pulled out from the apparatus main body 19, supplied with new paper P and pushed back into the apparatus main body 19, upon becoming empty due to the paper P therein being used up.

Figure 2:
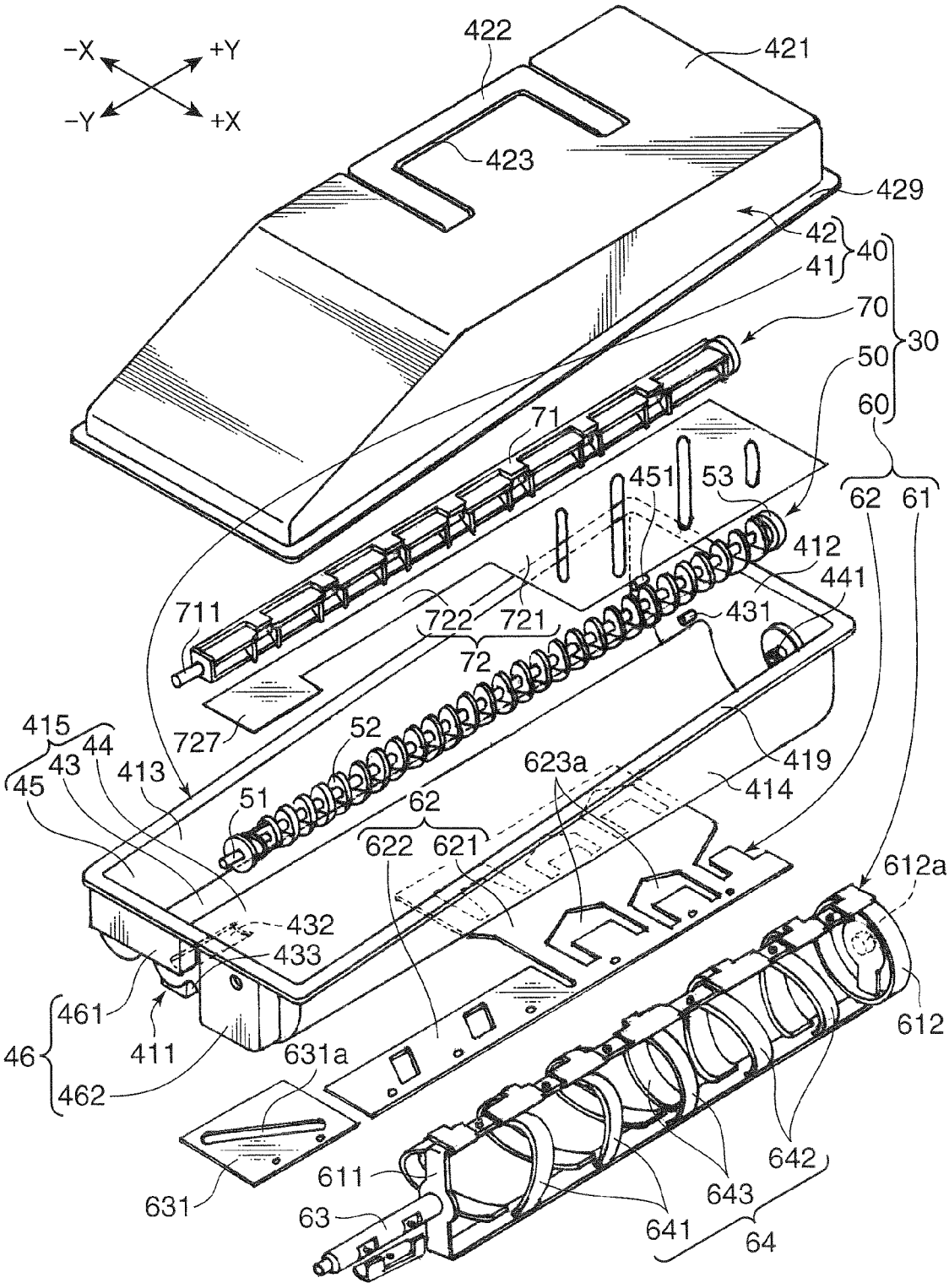
FIG. 2 is an exploded perspective diagram of a toner container.
Figure 3:
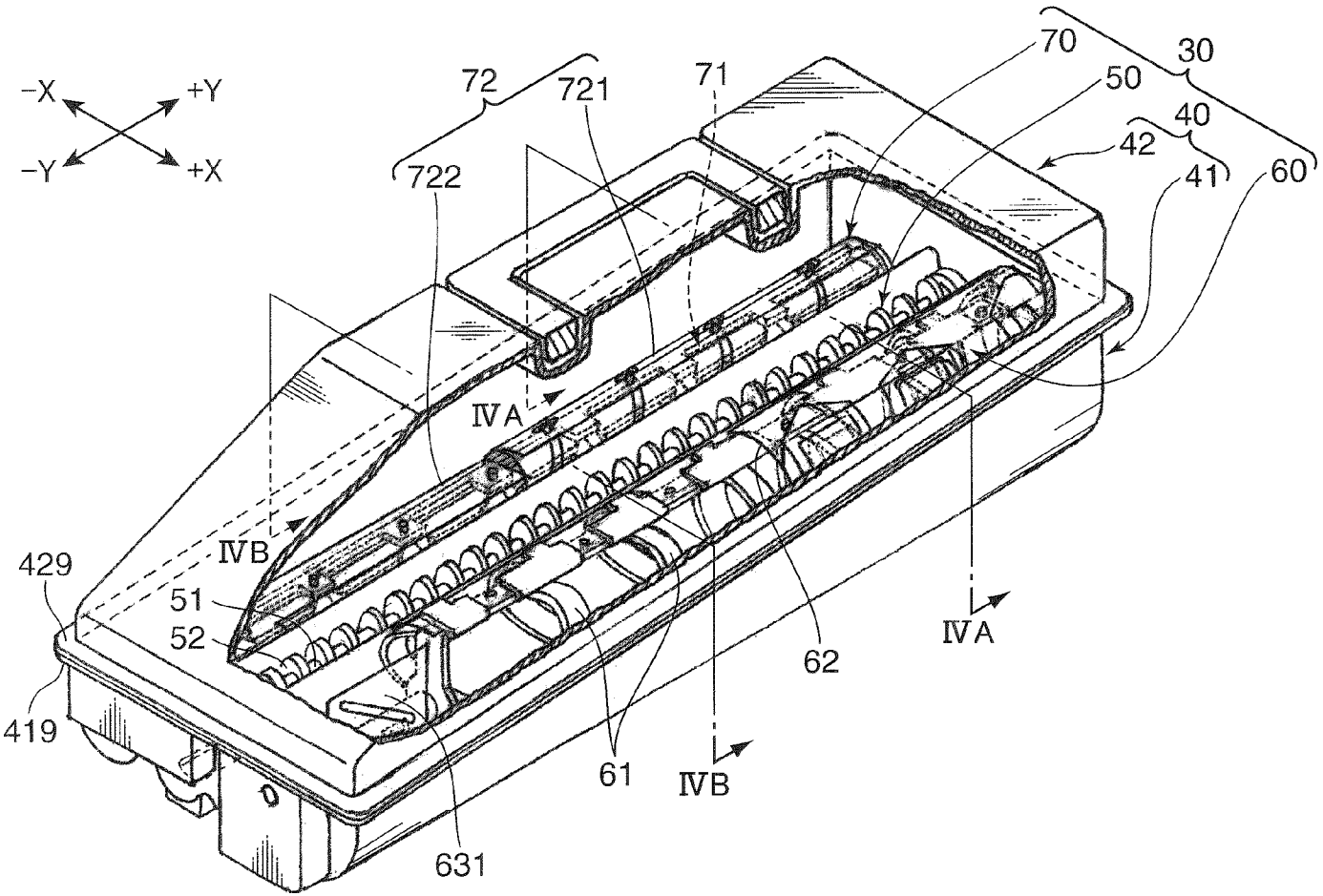
FIG. 3 is an assembly perspective diagram of the toner container shown in FIG. 2.
Figure 4A:
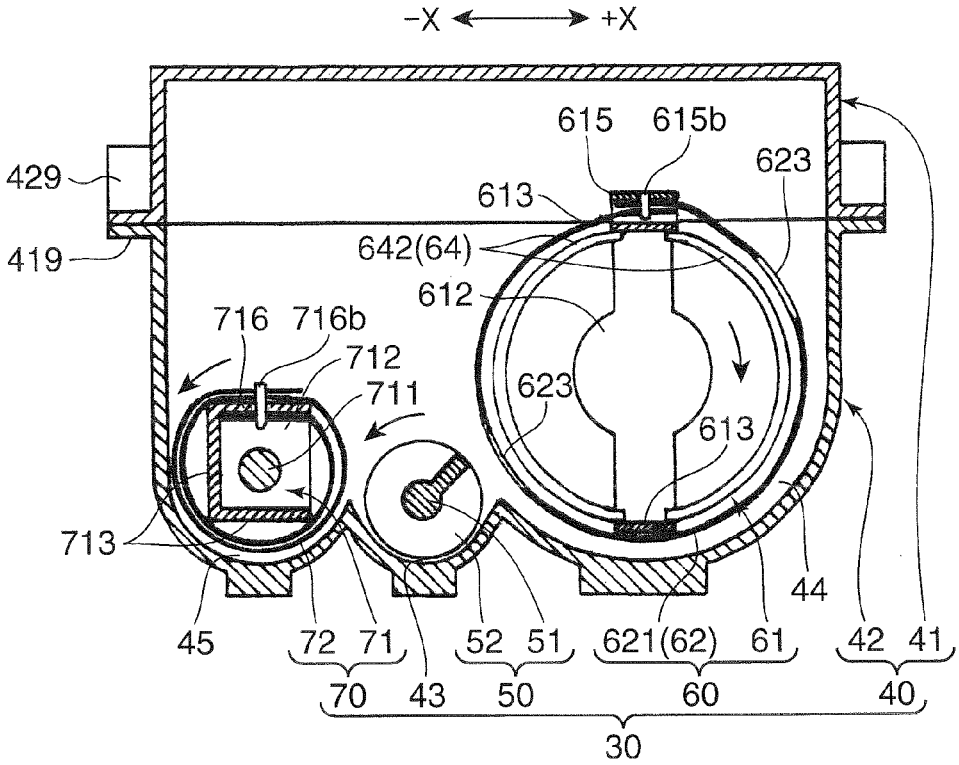
FIG. 4A is a cross-sectional diagram along line IVA-IVA in FIG. 3.
Figure 4B:
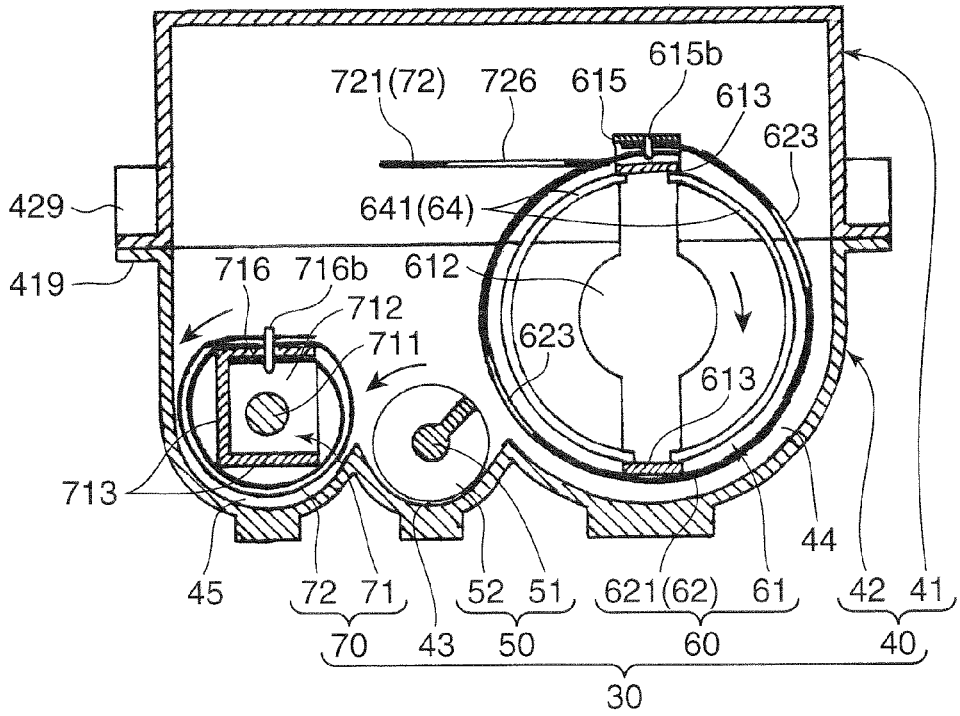
FIG. 4B is a cross-sectional diagram along IVB-IVB in FIG. 3.

FIG. 2 is an exploded perspective diagram of the toner container 30 and FIG. 3 is an assembly perspective diagram of same. Furthermore, FIG. 4A is a cross-sectional diagram along IVA-IVA in FIG. 3 and FIG. 4B is a cross-sectional diagram along line IVB-IVB in FIG. 3. The X direction in FIG. 2 to FIG. 4B indicates the left/right direction, and the Y direction indicates the forward/rearward direction. In particular, the −X direction is the leftward direction, the +X direction is the rightward direction, the −Y direction is the forward direction and the +Y direction is the rearward direction.

The toner container 30 is installed in the image forming apparatus 10 in a state of accommodating toner, and supplies toner to the developing apparatus 113 inside the image forming apparatus 10. The toner container 30 is detachable with respect to the image forming apparatus 10. When toner inside the toner container 30 has been consumed and become lower than a specified amount, the toner container 30 is removed from the image forming apparatus 10 and replaced with a new toner container 30 containing a sufficient amount of toner. By this means, new toner is supplied from the newly installed toner container 30 to the developing apparatus 113.

The toner container 30 includes a container body 40 which accommodates toner, a screw feeder 50 which is installed inside the container body 40, a first agitating member 60 and a second agitating member 70. The screw feeder 50 conveys toner that is to be supplied to the developer apparatus 113. The first agitating member 60 and the second agitating member 70 send toner inside the container body 40 toward the screw feeder 50, while agitating toner.

The container body 40 includes a container main body 41 which is a box-shaped container for accommodating toner, the upper portion of which is open, and a lid body 42 which closes off the upper opening of the container main body 41. The screw feeder 50 and the first and second agitating members 60 and 70 are installed inside the container main body 41. The container main body 41 includes a base surface portion 415 having a rectangular shape in planar view, and a front surface portion 411 (first side wall), a rear surface portion 412 (second side wall), a left-hand surface portion 413 and a right-hand surface portion 414, which are erected on the base surface portion 415.

Three circular arc-shaped grooves, each extending in the front/rear direction and having a circular arc shape in planar view when observed in the −Y direction (see FIG. 4A and FIG. 4B) are formed on the base surface portion 415 of the container main body 41. A feeder installation space 43 for installing the screw feeder 50 is the central circular arc groove of these grooves, a first agitating member installation space 44 for installing the first agitating member 60 is the right-hand circular arc groove, and a second agitating member installation space 45 for installing the second agitating member 70 is the left-hand circular arc groove.

A bearing section 46 for supporting the screw feeder 50 and the first and second agitating members 60 and 70 is provided in the front surface portion 411. This bearing section 46 includes a left-hand bearing unit 461 provided at a position corresponding to the screw feeder 50 and the second agitating member 70, and a right-hand bearing unit 462 corresponding to the first agitating member 60.

A drive force transmission pin 431 which engages with and transmits drive force to the screw feeder 50 is provided at a position corresponding to the screw feeder 50 in the rear surface portion 412, a drive force transmission pin 441 which engages with and transmits drive force to the first agitating member 60 is provided in a position corresponding to the first agitating member 60 in the rear surface portion 412, and a drive force transmission pin 451 which engages with and transmits drive force to the second agitating member 70 is provided in a position corresponding to the second agitating member 70 in the rear surface portion 412. The drive force of a drive motor (not illustrated) is transmitted via a prescribed reducing gear mechanism (not illustrated) to these drive force transmitting pins 431, 441, 451, whereby the screw feeder 50 and the first and second agitating members 60 and 70 are rotated inside the container main body 41.

A toner supply port 432 for supplying toner to the developing apparatus 113 is provided in a front end position of the feeder installation space 43 in the bottom surface section 415. A shutter portion 433 which protrudes in a downward direction from the bottom surface section 415 is provided in a position under the toner supply port 432. The shutter portion 433 is provided with a shutter plate (not illustrated) which changes from a state of closing off the toner supply port 432 to a state of opening the toner supply port 432, when the toner container 30 is installed in the developing apparatus 113. On the other hand, when the toner container 30 is removed from the developing apparatus 113, the shutter plate closes off the toner supply port 432 automatically.

The lid body 42 is a case with an open lower surface, so as to increase the capacity of the toner container 30. A handle 422 which enables convenient carrying of the toner container 30 is provided on the ceiling plate 421 of the lid body 42. This handle 422 can be changed between an accommodated posture in which the handle is lowered sideways and accommodated in a U-shaped recess 423 provided in the ceiling plate 421 and an erect posture in which the handle is erected on the ceiling plate 421. When the toner container 30 is carried, the handle 422 is set to the erect posture, whereas when the toner container 30 is installed in the developing apparatus 113, the handle 422 is set to the accommodated posture.

A lid side flange 429 formed projecting outwards from the whole circumference of the lower edge portion of the lid body 42 is provided on the periphery of the lower edge portion of the lid body 42. Furthermore, a main body side flange 419 corresponding to the lid side flange 429 is provided, projecting outwards from the whole circumference, on the periphery of the upper edge portion of the container main body 41.

By placing the lid side flange 429 on the main body side flange 419 and welding same together, in a state where the screw feeder 50 and the first and second agitating members 60 and 70 are installed inside the container main body 41, it is possible to obtain a toner container 30 as shown in FIG. 3.

Although not shown in FIG. 3, a toner filling hole for filling toner into the toner container 30 is provided in the front surface portion 411. The toner filling hole is usually plugged with a cap, but when filling toner into the container body 40, the cap is removed and in this state, toner is filled into the toner container 30 via the toner filling hole. By providing the toner filling hole on the front surface portion 411, it is possible to avoid the wide film 621 causing an obstruction to the inflow of toner to the toner container 30, described hereinafter, when filling toner.

The screw feeder 50 is installed in a state extending in the front/rear direction, in the feeder installation space 43 formed in the central portion in the left/right direction, of the interior of the container main body 41, and conveys toner inside the container body 40 toward the toner supply port 432. The screw feeder 50 includes an axis section 51, a screw section 52 formed on the outer peripheral surface of the axis portion 51, and a pin engagement section 53 which connects concentrically with the rear end of the axis section 51.

The front end of the axis section 51 is supported on the aforementioned bearing section 461 formed in the front surface portion 411. Furthermore, the drive force from the drive transmission pin 431 is transmitted to the pin engagement section 53 by the engagement with the drive transmission pin 431, thereby causing the axis section 51 to rotate. Toner inside the feeder installation space 43 is conveyed toward the toner supply port 432 due to the rotation of the screw portion 52 by the rotation of the axis section 51.

Figure 5:
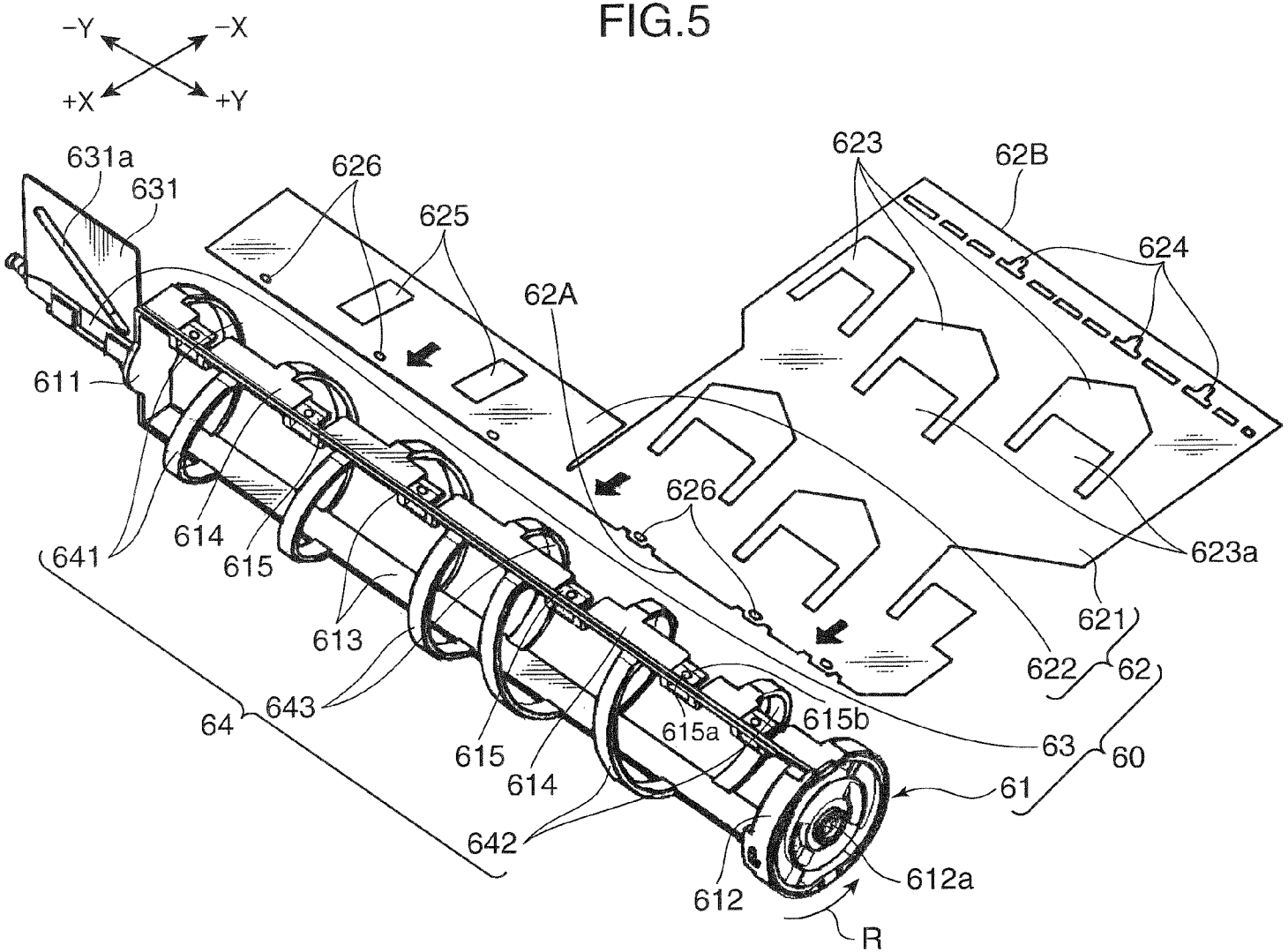
FIG. 5 is a perspective diagram showing a state before installing a first film member on a first skeleton body.
Figure 6:
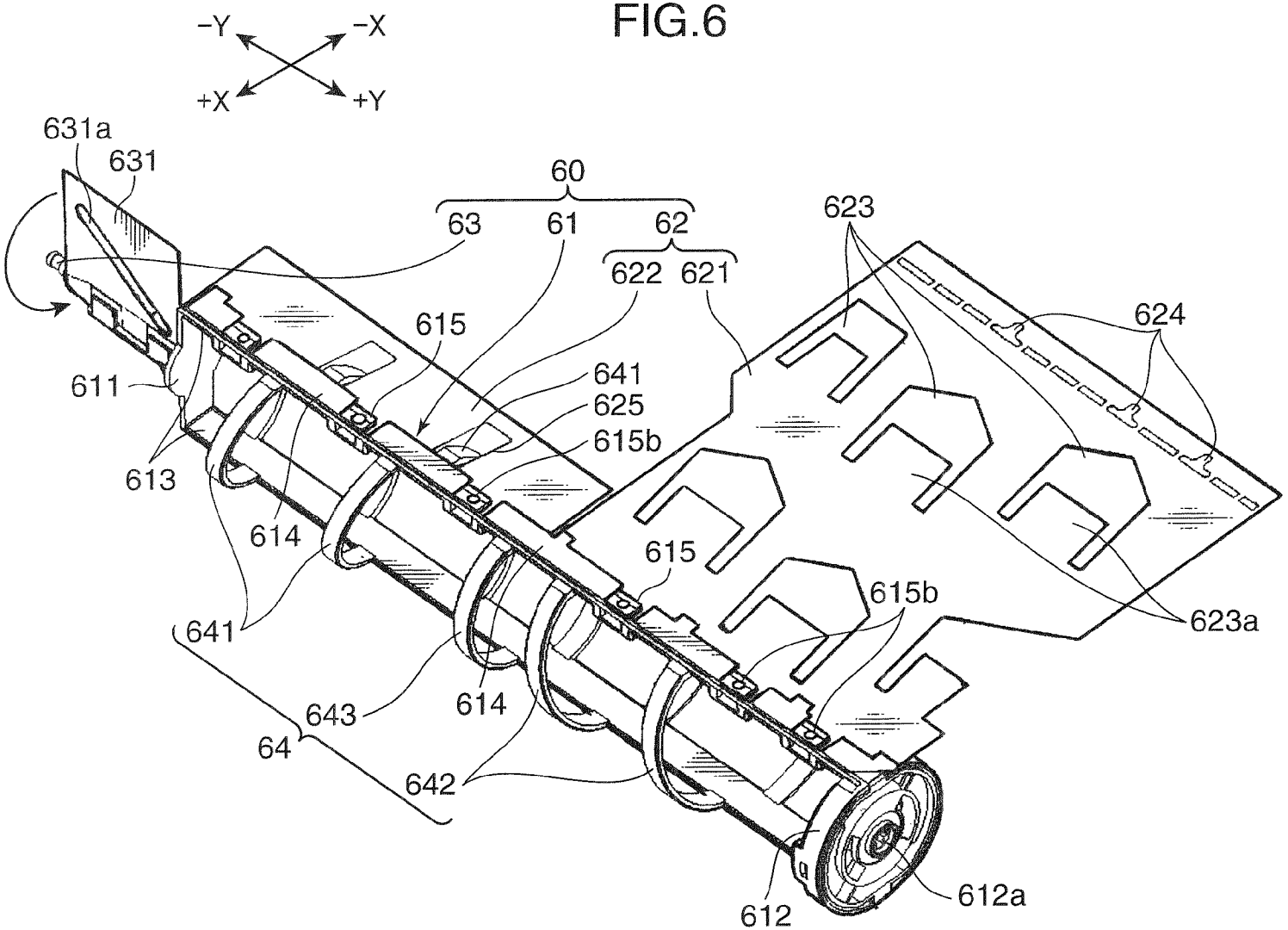
FIG. 6 is a perspective diagram showing a state where the first film member has been fixed on the first skeleton body.
Figure 7:
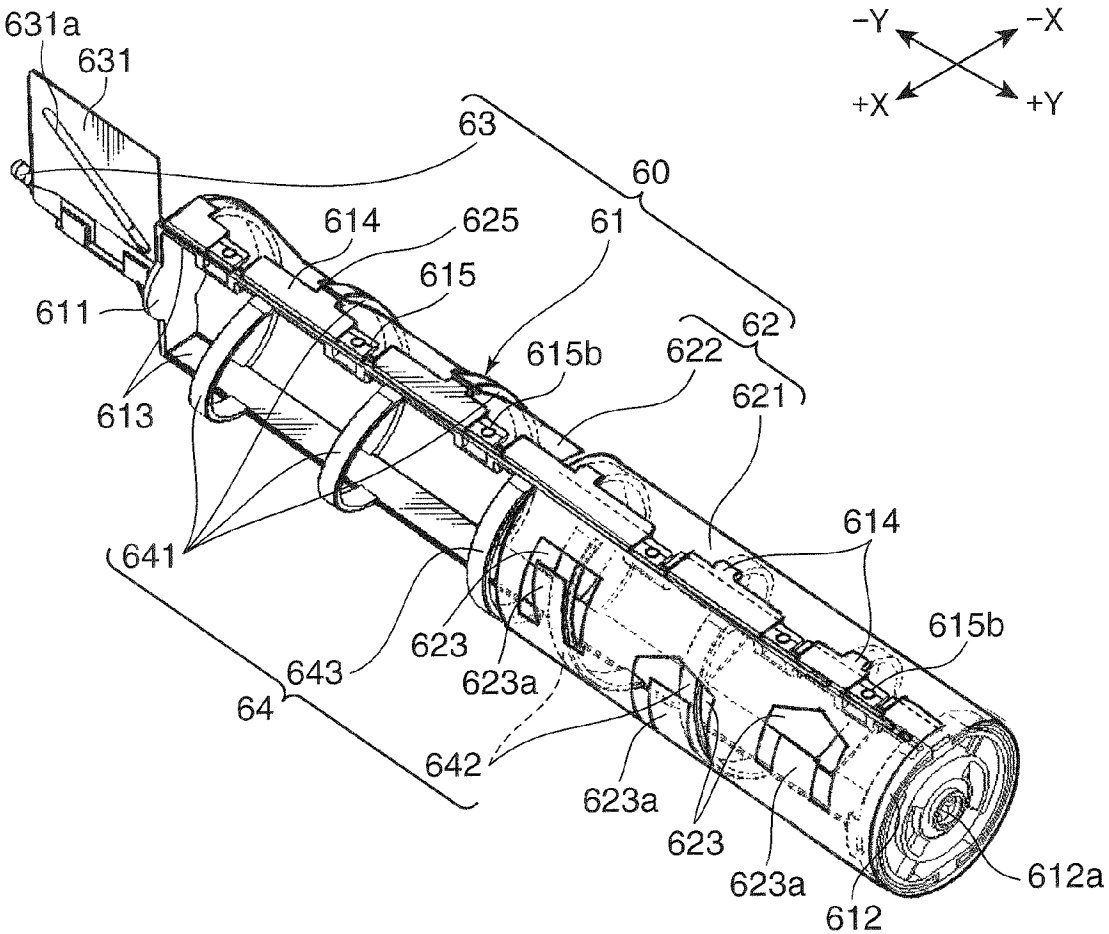
FIG. 7 is a perspective diagram showing a state where the first film member has been wrapped around the first skeleton body.

Below, the first agitating member 60 is described on the basis of FIG. 5 to FIG. 7, while referring to the other drawings as and where necessary. FIG. 5 is a perspective diagram showing a state prior to the installation of the first film member 62 on the first skeleton body 61; FIG. 6 is a perspective diagram showing a state where the first film member 62 is fixed on the first skeleton body 61; and FIG. 7 is a perspective diagram of a state where the first film member 62 is wrapped around the first skeleton body 61. The X and Y directions indicated in FIG. 5 to FIG. 7 are the same as those in FIG. 1 (−X: leftward; +X: rightward; −Y: forward; +Y: rearward).

The first agitating member 60 is installed in the first agitating member installation space 44 (FIG. 2) which extends in the front/rear direction and is formed at a position in substantially the right-hand half of the interior of the container main body 41, and includes a first skeleton body (tubular member) 61, a first film member 62 and a first central axis 63.

The first skeleton body 61 has a cylindrical (tubular) shape in overall views, and the outer diameter dimension thereof is set to a diameter slightly smaller than the internal diameter of curvature of the first agitating member installation space 44, in cross-sectional view from the front side. The first film member 62 is fixed on the first skeleton body 61. The first central axis 63 is provided so as to project concentrically forward from the front end face of the first skeleton body 61.

The first skeleton body 61 includes: a front end plate body 611, which is disposed in the front end portion of the first skeleton body 61 so as to pass through the cylindrical center of the first skeleton body 61 and which is set to a long dimension in the radial direction; a rear end circular disk 612, disposed in the rear end portion of the first skeleton body 61, having a diameter of the same dimension as the long dimension side of the front end plate body 611; a pair of long spanning plates (straight plate sections) 613 which is disposed between the respective end portions of the front end plate body 611 and the rear end circular disk 612; and a plurality of circular arc-shaped arch pieces 64 which span between this pair of long spanning plates 613. Tubular peripheral walls of the first skeleton body 61 are formed by the outer surfaces of the circular arc-shaped arch pieces 64. Openings through which toner can flow between the inside and outside of the first skeleton body 61 are formed between the plurality of circular arc-shaped arch pieces 64.

A drive force transmission hole 612*a* into which the drive force transmission pin 441 (FIG. 2) is inserted is provided concentrically with the first skeleton body 61 in a central position in the rear surface side of the rear end circular disk 612. By fitting the drive force transmission pin 441 into the drive force transmission hole 612*a*, the drive force of the drive motor, which is not illustrated, is transmitted to the first skeleton body 61 via the drive force transmission pin 441 and the drive force transmission hole 612*a*.

A plurality of (in the present embodiment, seven) gripping pieces 614 are provided on the outer surface of one of the pair of long spanning plates 613, so as to extend in a clockwise direction from the edge on the anti-clockwise side when viewed from the rear side. Furthermore, fixing pieces 615 are provided respectively between adjacent gripping pieces 614. The gripping pieces 614 serve to grip one edge portion 62A (a first side edge) of the first film member 62, and the fixing pieces 615 serve to fix the edge portion 62A of the first film member 62 which is gripped between the gripping pieces 614 and the long spanning plates 613. In the present embodiment, the fixing pieces 615 are each formed as a unified body with the gripping pieces 614.

Pin-shaped projections 615*b* are provided respectively to project through a prescribed length on the rear surface side of each fixing piece 615. In FIG. 5 to FIG. 7, although the pin-shaped projections 615*b* are members that are not actually exposed, their positions are depicted by solid lines in order to aid understanding. With the first film member 62 in a state of being wrapped around the whole circumference of the first skeleton body 61, the other edge portion 62B (second side edge) extending in the front/rear direction is externally fitted and engaged with the pin-shaped projections 615*b*. By this means, the first film member 62 is fixed on the first skeleton body 61, as shown in FIG. 6.

The first central axis 63 projects in a forward direction from a central position of the front face of the front end plate body 611. The first central axis 63 is supported on the right-hand bearing section 462 (FIG. 2) which is provided on the front surface portion 411 of the container main body 41. An agitator 631 made of film having a rectangular shape is fixed on the peripheral surface of the first central axis 63, in parallel with the axis thereof. A long hole 631*a* following the direction of a diagonal is provided in this agitator 631 in order to improve the agitating effect by allowing toner to pass through same. The agitator 631 agitates toner so as to prevent accumulation of toner in the vicinity of the toner supply port 432.

The circular arch-shaped arch pieces 64 serve to convey toner in the first agitating member installation space 44 toward the central portion in the front/rear direction while agitating toner, due to the rotation around the cylinder axis of the first skeleton body 61. The circular arc-shaped arch pieces 64 includes left screw-shape arch pieces 641 which are formed at positions in the front half of the first skeleton body 61, right screw-shape arch pieces 642 which are formed at positions in the rear half of the first skeleton body 61, and a middle arch piece 643 which is formed between the right and left screw-shape arch pieces 641, 642.

The left screw-shape arch pieces 641 span between the pair of long spanning plates 613 so as to follow a leftward screwing spiral as viewed from the end face of the first skeleton body 61. By this means, the left screw-shape arch pieces 641 which are on the right-hand side of the long spanning plates 613 have inclined edge surfaces with the upper portions inclined rearwards in right-side view as observed in the +X direction, and the left screw-shape arch pieces 641 which are on the left-hand side of the long spanning plates 613 have inclined edge surfaces with the upper portions inclined forwards in left-side view as observed in the −X direction.

On the other hand, the right screw-shape arch pieces 642 which are on the right-side of the long spanning plates 613 span between the pair of long spanning plates 613 so as to follow a rightward screwing spiral as viewed from the end face of the first skeleton body 61. By this means, the right screw-shape arch pieces 642 have inclined edge surfaces with the upper portions inclined forwards in right side view as observed in the +X direction, and those which are on the left-side of the long spanning plates 613 have inclined edge surfaces with the upper portions inclined rearwards in left side view as observed in the −X direction.

On the other hand, the middle arch piece 643 is formed without being inclined with respect to the cylinder axis of the first skeleton body 61 (in other words, without forming a spiral shape). Consequently, an inclined edge surface is not formed on the middle arch piece 643.

Incidentally, a leftward screwing spiral is a spiral formed so as to move toward the front end as it progresses in the counterclockwise direction as viewed from the base end face of the screw, and a rightward screwing spiral is a spiral formed so as to move toward the front end as it progresses in the clockwise direction as viewed from the base end face of the screw.

The circular arc-shaped arch pieces 64 are semicircular members, but from a different viewpoint, it can be regarded that one ring piece is formed by two adjacent arch pieces (for example, two leftward screw-shape arch pieces 641). A plurality of ring pieces are held in a state of alignment along the axis of the first central axis 63, by the long spanning plates 613 (holding members), and the presence of openings through which toner can pass can be seen between these ring pieces.

In relation to the circular arc-shaped arch pieces 64 having a structure of this kind, it is now supposed that the first skeleton body 61 is rotated around the cylindrical axis in a clockwise direction as viewed from the font end (the counterclockwise direction as viewed from the rear end). In this case, toner located on the front side in the first agitating member installation space 44 is conveyed rearwards due to the spiraling action of the leftward screw-shape arch pieces 641. Toner located on the rear side is conveyed forwards by the spiraling action of the rightward screw-shape pieces 642. In the position where the middle arch piece 643 is provided, toner conveyed from the respective directions collides together.

Due to this collision, toner mounds up, spills over the partition between the first agitating member installation space 44 and the feeder installation space 43, and enters into the feeder installation space 43. Toner which has entered into the feeder installation space 43 is conveyed forwards by the driving of the screw feeder 50, and is supplied to the developing apparatus 113 via the toner supply port 432 and the shutter portion 433.

The first film member 62 includes a portion (wide film 621) which covers the first skeleton body 61 in a tubular fashion, in order that the starting rotation of the first skeleton body 61 can be performed rapidly and smoothly.

A first film member 62 is employed for the reasons described below. More specifically, after manufacture, in the factory or warehouse, or during transportation, the toner container 30 is often placed vertically with the rear end portion 412 at the bottom, so as to increase the number of stored containers in plan view. If the toner container 30 is stored in this vertical placement for a long period of time, then toner located in the lower portion of the toner container 30 is pressed together by gravity and becomes coagulated.

If the first skeleton body 61 itself, or the first skeleton body 61 having only the short film member provided thereon, is rotated through this coagulated toner, then the resistance of the coagulated toner is very high indeed. Consequently, an extremely large torque is required in order to start the rotation of the first skeleton body 61. Therefore, it becomes necessary to raise the strength of the first skeleton body 61 and increase the size of the drive motor of the first skeleton body 61, and the like, which leads to increased costs.

In order to resolve problems of this kind, the first film member 62 is attached to the first skeleton body 61 in order to cover the outer periphery of the first skeleton body 61 in a tubular fashion. As shown in FIG. 5, the first film member 62 has a wide film 621 (film member) which is wrapped around the rear half portion of the first skeleton body 61 and a narrow film 622 (short film member) which is fixed on the font half portion of the first skeleton body 61. The wide film 621 and the narrow film 622 are mutually connected in their respective base end portions (first side edge; the edge portion 62A on the right-hand end in the example shown in FIG. 5).

The width dimension of the wide film 621 (the dimension in the direction where the wide film 621 is wrapped around the first skeleton body 61) is set to be slightly longer than the circumferential length of the first skeleton body 61. A plurality of through holes 623 are opened in the wide film 621 at positions opposing the gaps between the rightward screw-shape arch pieces 642, in a state where the wide film 621 is wrapped around the first skeleton body 61. The through holes 623 have a broader width than the arch pieces 642. The toner flows between the interior and exterior of the first skeleton body 61 via the through holes 623 and the gaps between the arch pieces 642.

The wide film 621 has notch pieces 623*a* which project inside the through holes 623 and which project outwards in a state where the wide film 621 is covering the periphery of the first skeleton body 61 in a tubular fashion. These notch pieces 623*a* project in an opposite direction to the direction of rotation of the first skeleton body 61 (the direction indicated by arrow R in FIG. 5). In the example shown in FIG. 5, the first skeleton body 61 is rotated in the counter-clockwise direction around the cylinder axis when viewed from the rear side, and therefore the notch pieces 623*a* are formed so as to extend in a clockwise direction. When the first skeleton body 61 is rotated around the cylinder axis, the notch pieces 623*a* interfere with the surrounding toner and perform a flapping motion, thereby improving the agitating effect for toner and breaking up the effect for toner.

T-shaped holes 624 corresponding to the pin-shaped projections 615*b* (FIG. 5) are opened in the edge portion 62B on the front end side of the wide film 621 (the second side edge; the left-hand side in FIG. 5). A plurality of fixation holes 626 are opened in the base end edge portion of the first film member 62 at positions corresponding to the pin-shaped projections 615*b*. The length of the first film member 62 between the fixation holes 626 and the T-shaped holes 624 is greater than the outer circumferential length of the first skeleton body 61.

The narrow film 622 is a rectangular-shaped member, and the width dimension thereof is set to be slightly smaller than the diameter of the first skeleton body 61. A plurality of (in the present embodiment, two) escape holes 625 (holes wider than the arch pieces) into which the leftward screw-shape arch pieces 641 can be fitted are opened in the narrow film 622 at positions corresponding to any of the leftward screw-shape arch pieces 641. The free end side (second side edge) of the narrow film 622 extends in the opposite direction to the direction of rotation of the first skeleton body 61.

The escape holes 625 are opened in the narrow film 622 in accordance with the disposition pitch of the leftward screw-shape arch pieces 641, along the cylinder axis direction. The leftward screw-shape arch pieces 641 are fitted into the escape holes 625 when the narrow film 622 becomes a deformed state so as to cover the periphery of the first skeleton body 61 in a circular arc shape, by the rotation of the first skeleton body 61.

For more details, as shown in FIG. 6 and FIG. 7, when the narrow film 622 deforms into a state where the leftward screw-shape arch pieces 641 are fitted respectively into the two escape holes 625, the openings present between the leftward screw-shape arch pieces 641 are substantially covered by the portion of the narrow film 622 present between the two escape holes 625, through the cylinder axis direction.

In the process to fix the first film member 62 having this structure on the first skeleton body 61, firstly, as shown by the thick black arrows in FIG. 5, the base end edge portion of the first film member 62 (the right-hand edge portion in the +X direction) is moved toward the gripping pieces 614 on the long spanning plate 613, the base end edge portion is inserted between the gripping pieces 614 (the fixing pieces 615) and the long spanning plate 613, and the respective fixation holes 626 are fitted into the corresponding pin-shaped projections 615*b*.

Thereupon, the wide film 621 is wrapped around the rear half of the first skeleton body 61, and subsequently, the T-shaped holes 624 are fitted over the corresponding the pin-shaped projections 615*b*. By this means, the first film member 62 is fixed on the first skeleton body 61 as shown in FIG. 7.

In the present embodiment, initially, the fixation holes 626 provided on one edge of the first film member 62 are fitted over the pin-shaped projections 615*b*, and the wide film 621 is wrapped around the first skeleton body 61, whereupon the T-shaped holes 624 provided on the other edge of the first film member 62 are fitted over the pin-shaped projections 615*b*. Instead of this, it is also possible firstly to fit the T-shaped holes 624 over the pin-shaped projections 615*b*, wrap the wide film 621 around the first skeleton body 61 and then fit the fixation holes 626 over the pin-shaped projections 615*b*.

By adopting a first agitating member 60 provided with a first film member 62 in this embodiment, toner filled into the toner container 30 is separated into an inner side and an outer side by means of the wide film 621 of the first film member 62. Therefore, even if toner inside the toner container 30 has coagulated, toner which needs to be broken up by the first skeleton body 61 at the start of rotation is substantially only toner inside the wide film 621. Accordingly, the initial rotational torque of the first skeleton body 61 is only small. Furthermore, when coagulated toner has been partially broke up, then as the edges of the through holes 623 break up coagulated toner, the remaining coagulated portion can also be broken up relatively easily, and therefore it is possible to break up the whole of the coagulated toner rapidly.

The narrow film 622 is provided in order to improve the toner agitating performance in the front half of the toner container 30. The narrow film 622 does not cover the first skeleton body 61 in a tubular fashion. However, since the position at which the narrow film 622 is fixed is a forward position in the container body 40, then even if the container body 40 is placed vertically with the rear surface portion 412 at the bottom, then there is no significant opportunities that toner coagulates in the portion where the narrow film 622 is situated. Consequently, the presence of the narrow film 622 is not liable to add a significant load to the drive mechanism at the start of rotation of the first agitating member 60.

One reason why the whole of the first film member 62 is not set to the size of the wide film 621 is in order to reduce the load during normal rotation of the first skeleton body 61. Attaching the long film to the first skeleton body 61 is beneficial in breaking up toner at the start of rotation, but does lead to a certain increase in the load during normal rotation. By forming a portion as the narrow film 622, the rotational load is reduced. A further reason for this is to improve the inflow speed of toner into the toner container 30 when toner is filled into the toner container 30. As described above, a toner filling hole (not illustrated) is often provided on the side of the front surface portion 411, but if a film covering the first skeleton body 61 in a tubular fashion is present in the vicinity of the toner filling hole, then there is a concern that the inflow of toner into the toner container 30 will not progress smoothly. Fixing the narrow film 622 on the first skeleton body 61 provides an improvement in this respect as well.

The narrow film 622 also is given measures for suppressing the initial rotational torque, supposing that toner coagulates in the portion where the narrow film 622 is provided. Normally, cutaway holes are provided in the agitating film member in order to promote deformation. These cutaway holes are formed in various shapes and having various inclinations, in order to enhance the agitating properties by changing the direction of deformation and in order to suppress the resistance to agitating by passing toner through the cutaway holes. However, if cutaway holes of this kind are provided, then if toner has coagulated, the edge portions of the cutaway holes, and the like, have a cause of increasing the resistance to agitating of toner. Moreover, if a structure is employed in which an agitator is fixed on the outer periphery of a tubular member, as in the present embodiment, then a problem also occurs in that the agitating resistance increases when toner is sandwiched between the tubular member and the agitator, and the fixing angle of the agitator with respect to the tubular member is displaced, and the like.

However, in the present embodiment, when the narrow film 622 is in a deformed state, the leftward screw-shape arch pieces 641 fit inside the escape holes 625. Therefore, toner is not sandwiched between the narrow film 622 and the leftward screw-shape arch pieces 641. Furthermore, the edges of the escape holes 625 are designed so as not to project from the outer circumferential portion of the first skeleton body 61. More specifically, the narrow film 622 can readily adapt to the outer periphery of the tubular member and the rotational torque at the start of rotation of the first skeleton body 61 can be reduced.

In particular, when the narrow film 622 has deformed, then the opening portions present between the leftward screw-shape arch pieces 641 are substantially covered by the narrow film 622, and the narrow film 622 assumes a state of wrapping around the periphery of the first skeleton body 61. Consequently, it is possible further to reduce the rotational torque at the start of rotation of the first agitating member 60.

Moreover, after the first agitating member 60 has transferred to normal rotation, it is possible to reduce the amount of curvature of the narrow film 622 in accordance with the amount by which the escape holes 625 fit over the leftward screw-shape arch pieces 641, and consequently, it is possible to avoid the application of unnecessary force to the narrow film 622.

Figure 8:
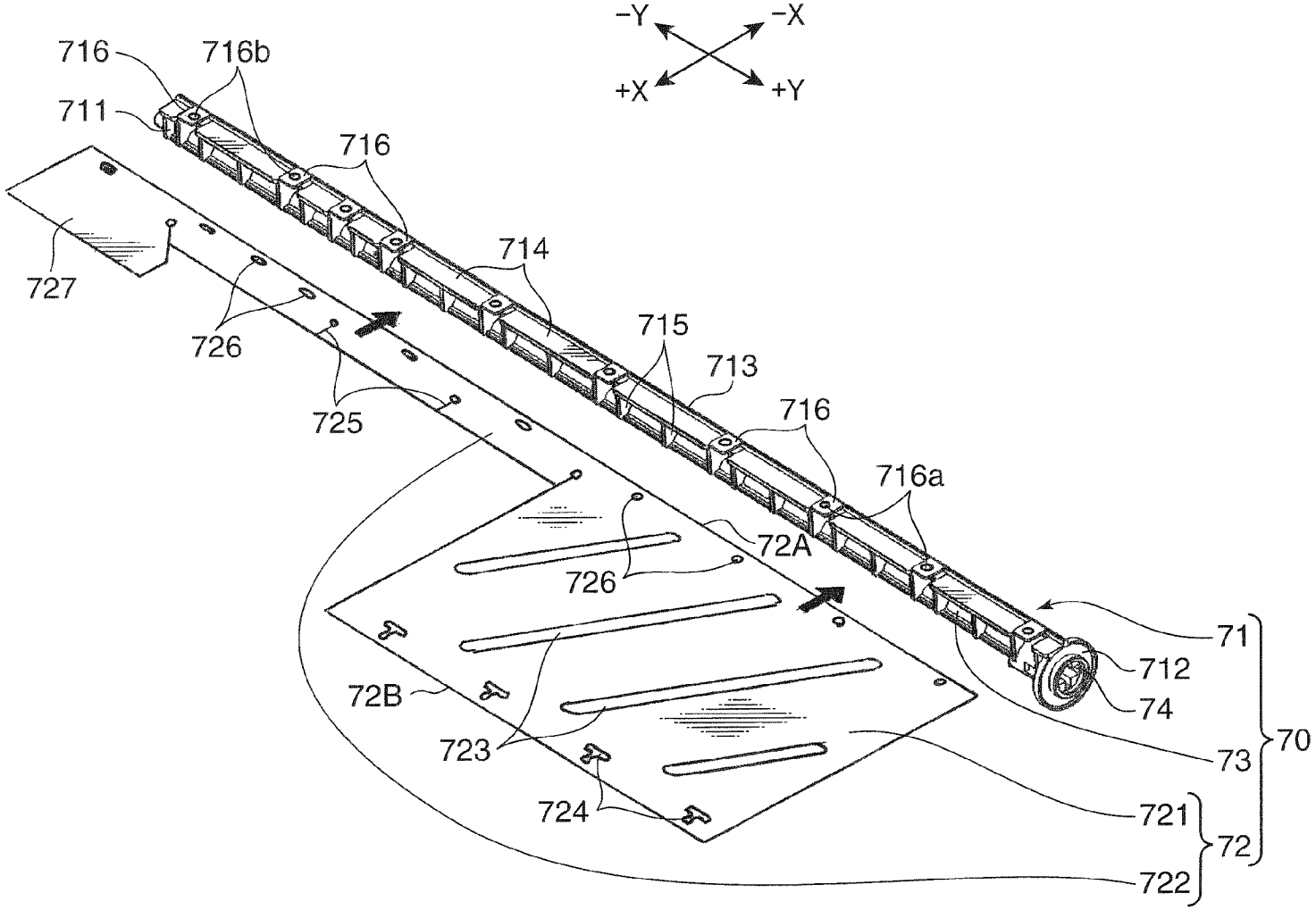
FIG. 8 is a perspective diagram showing a state before fixing a second film member on a second skeleton body.
Figure 9:
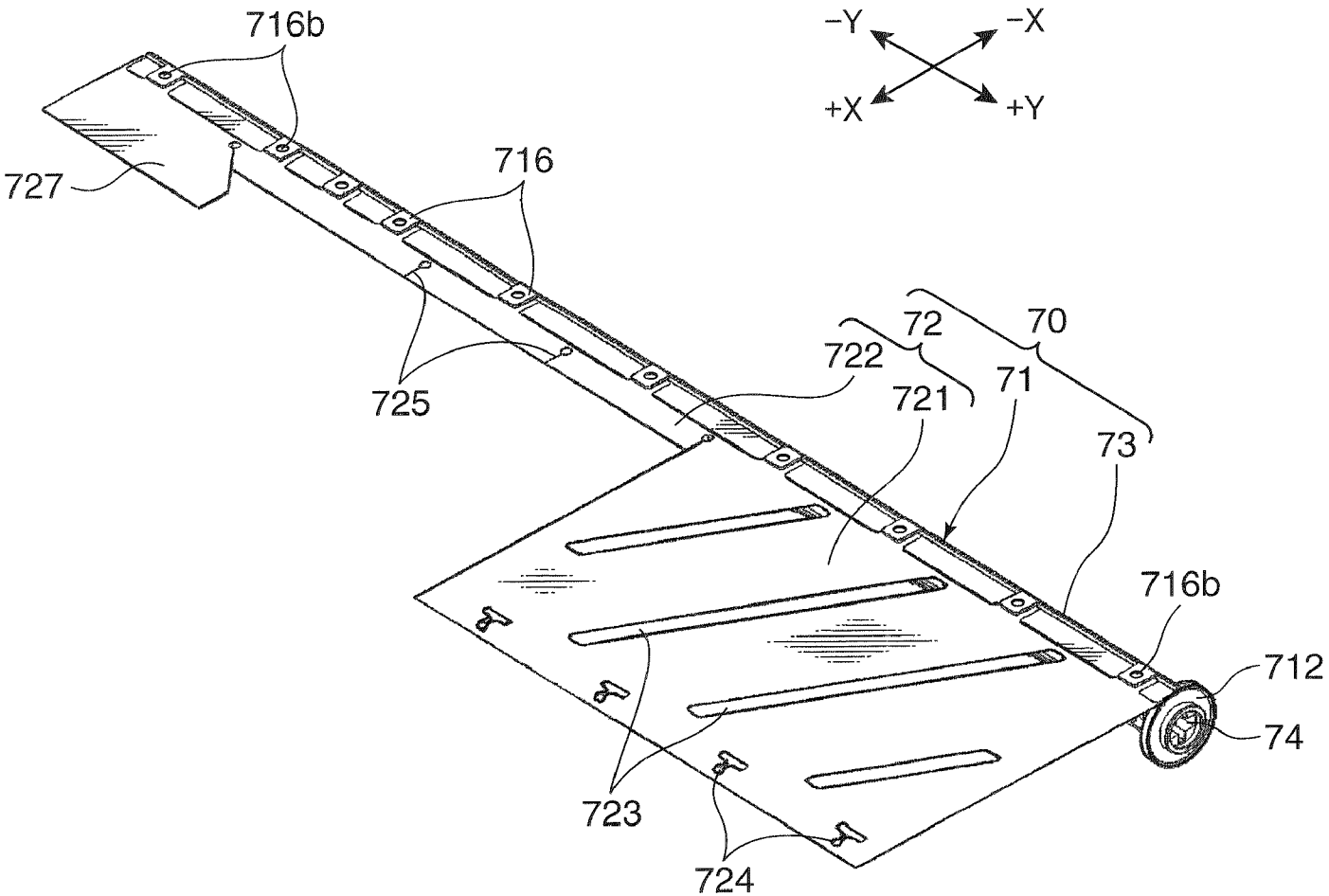
FIG. 9 is a perspective diagram showing a state where the second film member has been fixed on the second skeleton body.
Figure 10:
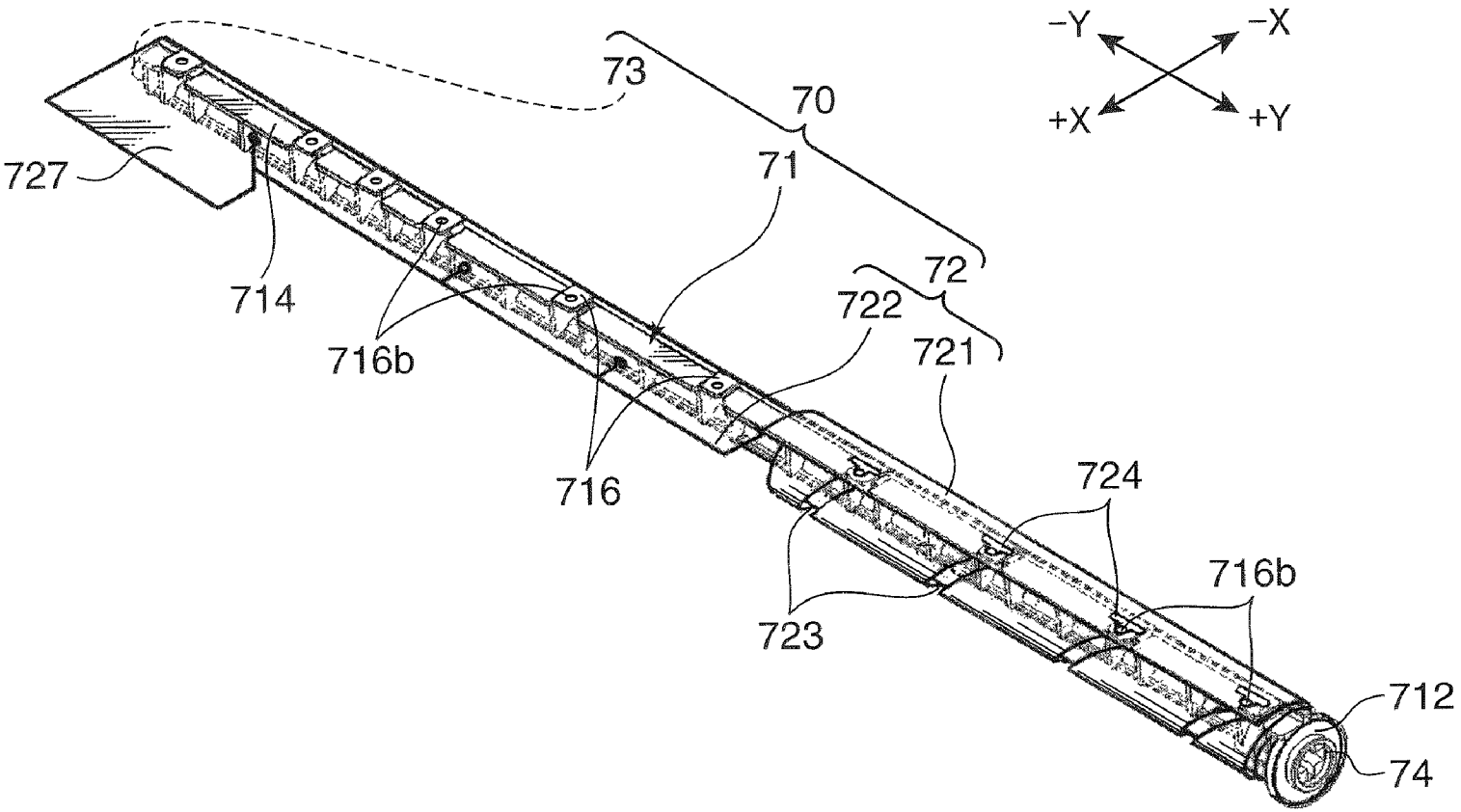
FIG. 10 is a perspective diagram showing a state where the second film member has been wrapped around the second skeleton body.

Next, the second agitating member 70 will be described on the basis of FIG. 8 to FIG. 10, while also referring to the other drawings, if necessary. FIG. 8 is a perspective diagram showing a state before a second film member 72 is fixed on a second skeleton body 71, FIG. 9 is a perspective diagram showing a state in which the second film member 72 has been fixed on the second skeleton body 71, and FIG. 10 is a perspective diagram showing a state where a second film member 72 is wrapped around a second skeleton body 71. The X and Y directions indicated in FIG. 8 to FIG. 10 are the same as those in FIG. 1 (−X: leftward; +X: rightward; −Y: forward; +Y: rearward).

The second agitating member 70 is installed in the second agitating member installation space 45 (FIG. 2) which extends in the front/rear direction and is formed at a position in substantially the left-hand half of the interior of the container main body 41 and the second agitating member 70 includes a second skeleton body (rod-shaped axis member) 71, a second film member 72 and a second central axis 73. The second skeleton body 71 is a member having a square cylindrical cross-sectional shape perpendicular to the axial direction, and the second film member 72 is fixed on the second skeleton body 71. The second central axis 73 is an axis member which passes through the second skeleton body 71 in the front/rear direction.

The second skeleton body 71 includes: a front end plate piece 711 having a substantially square shape, which is disposed in the front end portion of the second skeleton body 71; a rear end circular disk 712, disposed in the rear end portion of the second skeleton body 71, which has a diameter set to be slightly larger than the dimension of the diagonal of the front end plate piece 711; an angle member 713 having an L shape in cross-sectional view, which disposed between the front end plate piece 711 and the rear end circular disk 712; a plurality of short strip-shaped plates 714 respectively projecting at prescribed intervals toward the inside of the second skeleton body 71 from one side edge portion of the inner angle side of the angle member 713; a plurality of gripping ribs 715 which grip the second film member 72 together with the strip-shaped plates 714 formed on the inner angular portion of the angle member 713; and fixing pieces 716 for fixing the second film member 72, formed by projecting from the angle member 713 in the gap portions between the respective adjacent short strip-shaped plates 714.

The second central axis 73 is passed, in an integrated fashion with the gripping ribs 715, between the front end plate piece 711 and the rear end circular disk 712. The front end of the second central axis 73 projects outwards from the front end plate piece 711 and is supported on a left-side bearing unit 461 (FIG. 2) of the container main body 41. Furthermore, an integrated pin engaging section 74 is provided, in concentric fashion with the rear end circular disk 712, in the rear end portion of the second central axis 73. A drive force transmission pin 451 (FIG. 2) of the container main body 41 is fitted into this pin engaging section 74, when the second agitating member 70 is installed in the container main body 41. By means of this fitting action, the drive force of a drive motor (not illustrated) is transmitted to the second agitating member 70.

The second film member 72 is fixed on the second skeleton body 71 in non-disengaged state by pin-shaped projections **716*b* formed on the fixing pieces 716. The pin-shaped projections 716*b* are members which project toward the rear surface side of the fixing pieces 716, and in FIG. 8 to FIG. 10, although these members are not actually exposed, their positions are depicted by solid lines in order to aid understanding. The object of fixing the second film member 72 is similar to the case of the first film member 62 which is fixed on the first skeleton body 61; this second film member 72 is fixed in a state of forming a tubular shape on the second skeleton body 71 in order to enable to start the rotation of the second skeleton body 71 smoothly and rapidly. Consequently, even if toner in the toner container 30 has coagulated, then it is possible to start movement of the second agitating member 70**, rapidly and smoothly.

The second film member 72 is wrapped around the second skeleton body 71. As shown in FIG. 8, the second film member 72 includes a wide film 721 which is wrapped around the rear half of the second skeleton body 71 and a narrow film 722 which is fixed on the front half of the second skeleton body 71. The wide film 721 and the narrow film 722 are mutually connected at the edge portions 72A of their respective base end portions (third side edge; the left-hand edge portion of the second film member 72 in the example shown in FIG. 8).

The width dimension of the wide film 721 (the dimension in the direction where the wide film 721 is wrapped around the second skeleton body 71) is set to be slightly longer than twice the circumference of the second skeleton body 71. A plurality of inclined long holes 723 are opened in the wide film 721, being designed so as to externally expose the pin-shaped projections **716*b* of the fixing pieces 716 when the wide film 721 is wrapped around the second skeleton body 71. Furthermore, T-shaped holes 724 corresponding to the fixing pieces 716 are opened in the edge portion 72B (fourth side edge) on the front end side of the wide film 721 (the right-hand (+X) side in FIG. 8), in a state where the stem portion of the T shape is facing toward the front end side (the right-hand side in FIG. 8**).

The narrow film 722 is set to have a width slightly greater than the length of one edge of the second skeleton body 71 when viewed in the front/rear direction. A plurality of incision lines 725 are provided in the narrow film 722, the lines being formed by cutting into the narrow film 722 through a prescribed dimension from the front end side edge toward the based end side edge.

Fixing holes 726 are opened in the edge portion 72A on the base end side of the second film member 72, at positions corresponding to the fixing pieces 716. Furthermore, an agitator 727 having a greater width dimension than the narrow film 722 is formed in the front end side of the narrow film 722. This agitator 727 performs the same role as the agitator 631 of the first agitating member 60, in other words, a role of avoiding accumulation of toner on the wall surfaces of the front end of the second agitating member installation space 45.

When the second film member 72 is fixed on the second skeleton body 71, firstly, as indicated by the black arrows in FIG. 8, the base end side edge portion 72A of the second film member 72 is inserted into the gaps between the respective gripping ribs 715 and the strip-shaped plates 714 corresponding to same, and the fixing holes 726 are fitted externally over the front ends of the pin-shaped projections 716*b*. In so doing, as shown in FIG. 9, the base end side edge portion 72A of the second film member 72 assumes a fixed state on the second skeleton body 71.

In this state, by wrapping the wide film 721 around the rear half of the second skeleton body 71 and then fitting the respective T-shaped holes 724 of the front end side edge portion 72B over the externally projecting portions of the corresponding pin-shaped projections 716*b*, the second film member 72 is fixed on the second skeleton body 71 as shown in FIG. 10.

According to the second agitating member 70, even if toner is coagulated in the rear half of the toner container 30, since toner is in a partitioned state on either side of the wide film 721 which is formed in a tubular shape, then the second skeleton body 71 is able to start rotation easily by means of a low torque. If the rotation of the second skeleton body 71 is continued, then the lumps of coagulated toner are broken up by the edge portions of the inclined long holes 723 formed in the wide film 721, and therefore toner is progressively loosened, which means that the lumps of coagulated toner can be returned rapidly to a state of individual toner particles.

Furthermore, in the front half of the toner container 30, toner is agitated by the narrow film 722. The reason why the whole of the second film member 72 is not set to the size of the wide film 721, but further includes a narrow film 722 is similar to the case of the first film member 62 described above, namely, in order to reduce torque during normal rotation of the second agitating member 70 and due to considerations of the operability of toner filling.

As described in detail above, the toner container 30 according to the present invention is installed detachably in the image forming apparatus 10 in a state of containing toner, and serves to supply toner to the developer apparatus 113. The toner container 30 includes a container body 40 which accommodates toner, and first and second agitating members 60, 70 which are disposed inside this container body 40 and agitate toner.

The first and second agitating members 60 and 70 includes first and second skeleton bodies 61, 71 as drive members, and first and second film members 62, 72 as film members which are respectively fixed on the peripheries of the skeleton bodies. The first film member 62 has a wide film 621 which covers the periphery of the first skeleton body 61 in a tubular fashion, and the second film member 72 also has a wide film 721 which covers the periphery of the second skeleton body 71 in a tubular fashion.

Due to the presence of the wide films 621 and 721, toner filled inside the container body 40 is divided between the inside and the outside of these films. Therefore, even if toner inside the container body 40 has coagulated, toner which needs to be broken up by the first and second agitating members 60 and 70 at the start of rotation is substantially only toner inside the wide films 621 and 721. Consequently, only a small initial rotational torque of the first and second agitating members 60 and 70 is required. Furthermore, as coagulated toner is partially broken up, the remaining coagulated portion becomes relatively easier to break up, and therefore the whole of coagulated toner can be broken up rapidly.

The present invention is not limited to the embodiment described above and may also encompass the following contents.

(1) In the embodiment described above, a copying machine was described as an example of an image forming apparatus 10 to which the toner container 30 relating to the present invention was applied, but instead of a copying machine, the image forming apparatus may also be a printer or facsimile machine.

(2) In the present embodiment, it is also possible to omit the portion of the narrow film 622 in the first film member 62 which is fixed on the first skeleton body 61 and to use a first film member 62 composed of a wide film 621 portion only. Similarly, it is also possible to omit the portion of the narrow film 722 in the second film member 72 fixed on the second skeleton body 71 and to use a second film member 72 composed of a wide film 721 portion only.

(3) In the embodiment described above, an example is described in which both a first agitating member 60 and a second agitating member 70 are provided on either side of a screw feeder 50 inside a container main body 41. Instead of this, it is also possible to omit either one of the first agitating member 60 and the second agitating member 70.

(4) In the embodiment described above, an example was described in which a function of conveying toner toward the central portion inside the container main body 41 was added to the first agitating member 60. Instead of this, it is also possible to add a function of conveying toner to the end portion on the side where the toner supply port 432 is provided.

(5) In the embodiment described above, a toner container 30 was given as an example of a toner supply apparatus. The toner supply apparatus may also be a so-called developing unit in which a developing apparatus and a toner container are unified in a single body. In this case, when toner runs out, the developing unit is replaced with a new one. In this case, the developing unit is regarded as the toner supply apparatus relating to the present invention which supplies toner to the photosensitive drum 112.

(6) In the embodiment described above, the base end edge portion and the front end edge portion of the wide film 621 in the circumferential direction of the first skeleton body 61 are engaged by pin-shaped projections 615*b*, but it is also possible for the front end edge portion only to be a free end which is not engaged by the pin-shaped projections 615*b*. In so doing, when the first agitating member 60 is rotated, the front end edge portion of the wide film 621 rubs against a part which corresponds to the first agitating member installation space 44 in the bottom surface portion 415 of the container main body 41, thereby wiping away toner attached to the wall surface, and therefore it is possible to avoid the occurrence of residual toner inside the toner container 30, more effectively.

(7) In the embodiment described above, it is possible to provide a spiral feeder as a toner conveyance mechanism which rotates in unison with the first skeleton body 61, at a central position of the first skeleton body 61 which is a tubular member. This spiral feeder is constituted by an integrated drive axis which is concentric with the above, and a spiral fin provided in a concentric and integrated fashion with the drive axis. By providing a spiral feeder of this kind inside the first skeleton body 61, it is possible to improve the toner conveyance capability in comparison with the conveyance mechanism of the embodiment described above which conveys toner by the rotation of the circular arc-shaped arch pieces 64 only.

(8) In the embodiment described above, a round tubular first skeleton body 61 and a second skeleton body 71 having a square tubular rod shape were given as examples of drive members. Apart from this, the drive member may be a triangular tubular shape, or any other polygonal tubular shape, such as a pentagonal or hexagonal tubular shape.

According to the toner supply apparatus relating to the present invention which was described above, toner filled into the container body is in a partitioned state between an inner side and an outer side, by means of a film member which covers the periphery of the drive member in a tubular fashion. Therefore, even if toner inside the container body has coagulated, toner which needs to be broken up by the drive member at the start of rotation is substantially only toner inside the tubular film member. Accordingly, the initial rotational torque of the drive member is only small. Furthermore, as coagulated toner is partially broken up, the remaining coagulated portion becomes relatively easier to break up, and therefore the whole of coagulated toner can be broken up rapidly.

This application is based on Japanese Patent Application Serial Nos. 2009-020884 and 2009-020904, filed in Japan Patent Office on Jan. 30, 2009 respectively, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. A toner supply apparatus installed detachably in an image forming apparatus, comprising:

a container body which accommodates toner; and an agitating member which is disposed inside the container body and is driven to rotate so as to agitate toner, wherein the agitating member includes a drive member which is driven to rotate and a film member which is fixed on the drive member, and the film member covers the periphery of the drive member in a tubular fashion.

2. The toner supply apparatus according to claim 1, wherein the drive member is a tubular member having a tubular peripheral wall having a center and being rotatable around the center of the tubular peripheral wall, the tubular peripheral wall being provided with openings through which toner is passed, and the film member is fixed on an outer peripheral surface of the tubular peripheral wall.

3. The toner supply apparatus according to claim 2, wherein the tubular member includes a pair of straight plate sections disposed in parallel with the tube center direction at an interval apart, and a plurality of semicircular arch pieces which is disposed between the pair of straight plate sections, gaps between adjacent arch pieces serving as the openings, and the film member is a rectangular member, a first side edge thereof being fixed on one of the straight plate sections and the length from the first side edge until an opposing second side edge thereof being a length of at least approximately one revolution around the periphery of the tubular member.

4. The toner supply apparatus according to claim 1, wherein the drive member is a tubular member including a plurality of ring pieces and a holding member which holds these ring pieces in a state of alignment along one axis, openings through which toner is passed being provided between the ring pieces, and the film member is fixed on the holding member.

5. The toner supply apparatus according to claim 4, wherein at least some of the plurality of ring pieces are formed in a spiral shape so as to convey toner.

6. The toner supply apparatus according to claim 2, wherein the film member is provided with through holes in portions which oppose the openings of the tubular member in a state where the film member has covered the periphery of the tubular member in a tubular fashion.

7. The toner supply apparatus according to claim 6, wherein the film member is provided with notch pieces which project inside the through holes and project outwards in a state where the film member has covered the periphery of the tubular member in a tubular fashion.

8. The toner supply apparatus according to claim 2, wherein at least a portion of the tubular peripheral wall of the tubular member is constituted by a plurality of circular arc-shaped arch pieces, and openings provided between adjacent arch pieces, and the film member has hole portions wider than the arch pieces in portions corresponding to the arch pieces in a state where the film member is laid along the periphery of the tubular member.

9. The toner supply apparatus according to claim 1, wherein the drive member is a rod-shaped axis member which is rotatable around the axis thereof, and the film member is fixed on the axis member in a state of having been formed into a tubular shape.

10. The toner supply apparatus according to claim 1, wherein the drive member is driven to rotate about an axis member of the drive member, the film member is rectangular, a first side edge the film member is fixed on the axis member, and a second side edge which opposes the first side edge is fixed on the axis member in a state where the film member has covered a periphery of the axis member in a tubular fashion.

11. The toner supply apparatus according to claim 1, wherein the container body has a first side wall and a second side wall opposing the first side wall, the drive member is supported rotatably between the first side wall and the second side wall, a toner filling hole for filling toner into the container body is provided in the first side wall, and the film member which covers the periphery of the drive member in a tubular fashion is a member that is shorter than a length of the drive member in an axial direction of the drive member, and is fixed on an end of the drive member in proximity to the second side wall of the container body.

12. The toner supply apparatus according to claim 11, wherein a film member that is shorter than the film member which covers the periphery of the drive member in a tubular fashion is fixed on an end of the drive member in proximity to the first side wall of the container body.

13. The toner supply apparatus according to claim 12, wherein the drive member is a tubular member having a tubular peripheral wall, at least a portion of the tubular peripheral wall of the tubular member is constituted by a plurality of circular arc-shaped arch pieces, and openings provided between adjacent arch pieces, and the film member has hole portions wider than the arch pieces in portions corresponding to the arch pieces in a state where the film member is laid along the periphery of the tubular member.

14. The toner supply apparatus according to claim 13, wherein the film member includes at least two hole portions, and when the film member has deformed into a state where the arch pieces are respectively fitted into the two hole portions, at least a portion of the openings present between the arch pieces are substantially covered by the portion of the film member, which is present between the two hole portions.

* * * * *